US005816346A

United States Patent [19]

Beaton

[11] Patent Number: 5,816,346

[45] Date of Patent: Oct. 6, 1998

[54] ROTARY DRILL BITS AND METHODS OF DESIGNING SUCH DRILL BITS

[75] Inventor: Timothy P. Beaton, Houston, Tex.

[73] Assignee: Camco International, Inc., Austin, Tex.

[21] Appl. No.: 659,502

[22] Filed: Jun. 6, 1996

[51] Int. Cl.[6] ..... E21B 10/46

[52] U.S. Cl. ..... 175/431

[58] Field of Search ..... 175/376, 377, 175/378, 398, 431

[56] References Cited

U.S. PATENT DOCUMENTS

| | | | |
|---|---|---|---|
| 5,222,566 | 6/1993 | Taylor et al. | 175/431 |
| 5,244,039 | 9/1993 | Newton, Sr. et al. | 175/431 |
| 5,346,025 | 9/1994 | Keith et al. | 175/431 X |
| 5,549,171 | 8/1996 | Mensa-Wilmot et al. | 175/431 |
| 5,607,024 | 3/1997 | Keith et al. | 175/431 |
| 5,607,025 | 3/1997 | Mensa-Wilmot et al. | 175/431 |

*Primary Examiner*—William P. Neuder
*Attorney, Agent, or Firm*—Fletcher, Yoder & Edwards

[57] ABSTRACT

A rotary drill bit for drilling subsurface formations comprises a bit body having a shank for connection to a drill string, a plurality of primary blades and at least one secondary blade circumferentially spaced and extending outwardly away from a central axis of rotation of the bit, a plurality of cutters mounted along each blade, a majority of the cutters mounted on each of the primary blades having a greater exposure than a majority of the cutters on the secondary blade, and a sweep angle of the secondary blade is less than a sweep angle of the primary blades. The drill bit will exhibit a rate-of-penetration as a function of the size of the cutters on the primary blades, and exhibit a torque profile as a function of the size of the cutters on the at least one secondary blade.

37 Claims, 6 Drawing Sheets

FIG. 6

| CUTTER SIZE | RADIUS | VOLUME OF ROCK REMOVED |
|---|---|---|
| LARGE | 6.69 | 225.35 |
| LARGE | 13.73 | 534.84 |
| LARGE | 20.78 | 652.71 |
| LARGE | 24.86 | 699.10 |
| LARGE | 28.58 | 909.69 |
| LARGE | 33.10 | 890.23 |
| LARGE | 36.70 | 844.84 |
| LARGE | 40.30 | 927.00 |
| LARGE | 43.87 | 1032.31 |
| LARGE | 47.45 | 961.99 |
| SMALL | 50.44 | 979.90 |
| LARGE | 52.77 | 800.21 |
| SMALL | 55.03 | 931.42 |
| LARGE | 56.75 | 902.67 |
| SMALL | 60.14 | 706.22 |
| SMALL | 61.09 | 558.02 |
| LARGE | 61.22 | 772.76 |
| LARGE | 63.41 | 553.91 |
| SMALL | 65.58 | 687.25 |
| SMALL | 65.85 | 391.02 |
| SMALL | 67.53 | 625.32 |
| SMALL | 68.62 | 647.55 |
| LARGE | 70.20 | 571.68 |
| SMALL | 70.56 | 511.82 |
| SMALL | 70.75 | 555.88 |
| LARGE | 72.49 | 591.90 |
| SMALL | 73.24 | 751.34 |
| LARGE | 74.46 | 421.55 |
| LARGE | 75.42 | 306.01 |
| SMALL | 75.78 | 656.06 |
| LARGE | 77.77 | 93.59 |

ROTARY DRILL BITS AND METHODS OF DESIGNING SUCH DRILL BITS

BACKGROUND OF THE INVENTION

1. Field of the Invention

The invention relates to rotary drill bits for drilling or coring holes in subsurface formations and, more particularly, to drag type drill bits that have cutters thereon of differing sizes.

2. Description of Related Art

Rotary drill bits usually comprise a bit body having a shank for connection to a drill string, a plurality of circumferentially spaced blades on the bit body each extending outwardly away from the central axis of rotation of the bit, and a plurality of cutters mounted along each blade. In some of these drill bits at least two sizes of cutters are used thereon to provide a duality of purpose or benefit not found in drill bits having all the same sized cutters. One specific example of a drill bit having large and small cutters is disclosed in U.S. Pat. No. 5,222,566, which is commonly assigned hereto, and which is hereby incorporated by reference. In the '566 Patent the drill bit has large cutters on the blades with greater radial extent, i.e. longer blades, and small cutters on the shorter blades. The blades are arranged so that the smaller or shorter blades have less sweep angle proportionately than the larger or longer blades. In other words, radial gap from a front face of a longer blade to a front face of a trailing shorter blade is less than the radial gap from a front face of a shorter blade to a front face of a trailing longer blade. The benefits of this arrangement is that the drill bit tends to act as a "heavy set" drill bit at lower rates of penetration in hard formations, and as a "light set" drill bit at higher rates of penetration in softer formations, and therefore tends to drill each formation more efficiently.

A problem encountered with small/large cutter drill bits is that the rate of penetration (ROP) is primarily dependent upon the size of the small cutters, with the ROP for a small cutter drill bit being less than for a large cutter drill bit for a soft formation. To increase the ROP, larger cutters than desired had to be used. A second problem encountered with small/large cutter drill bits is that the torque response of the drill bit is primarily dependent upon the size of the large cutters. For large cutters, the torque can rapidly increase and decrease which can severely damage the fragile polycrystalline diamond compacts (PDC) used as the cutter faces. In order to smooth the torque response and increase the life of the cutters, smaller cutters than desired had to be used.

There is a need for a drill bit that has small and large cutters as before, but with the torque response smoother and with a higher ROP than conventional drill bits of this type.

SUMMARY OF THE INVENTION

The present invention has been contemplated to overcome the foregoing deficiencies and meet the above described needs. In particular, the present invention comprises a rotary drill bit for drilling subsurface formations with a bit body having a shank for connection to a drill string. A plurality of primary blades and at least one secondary blade are circumferentially spaced and extend outwardly away from a central axis of rotation of the bit. A plurality of cutters are mounted along each blade with a majority of the cutters mounted on each of the primary blades having a greater exposure than a majority of the cutters on the secondary blade. Further, a sweep angle of the secondary blade is less than a sweep angle of the primary blades. An important benefit of this type of drill bit is that it will exhibit a rate of penetration (ROP) as a function of the size of the cutters on the primary blades. When larger sized cutters are used on the primary blades, the drill bit will have a greater rate of penetration that a comparable drill bit having primarily smaller sized cutters. Additionally, the drill bit will have a relatively low torque profile, since its torque characteristics will be determined as a function of the smaller sized cutters on the at least one secondary blade, and not by the larger cutters.

BRIEF DESCRIPTION OF THE DRAWINGS

FIG. 6 is a table showing the volume of rock removed for certain cutters on an example drill bit of the present invention.

DETAILED DESCRIPTION OF THE PREFERRED EMBODIMENTS

In this specification, in relation to the relative location of cutters blades on the drill bit, expressions such as "forwardly", "rearwardly", "preceding" and "following" refer to relative positions in relation to the normal direction of forward rotation of the drill bit.

Figure 1:
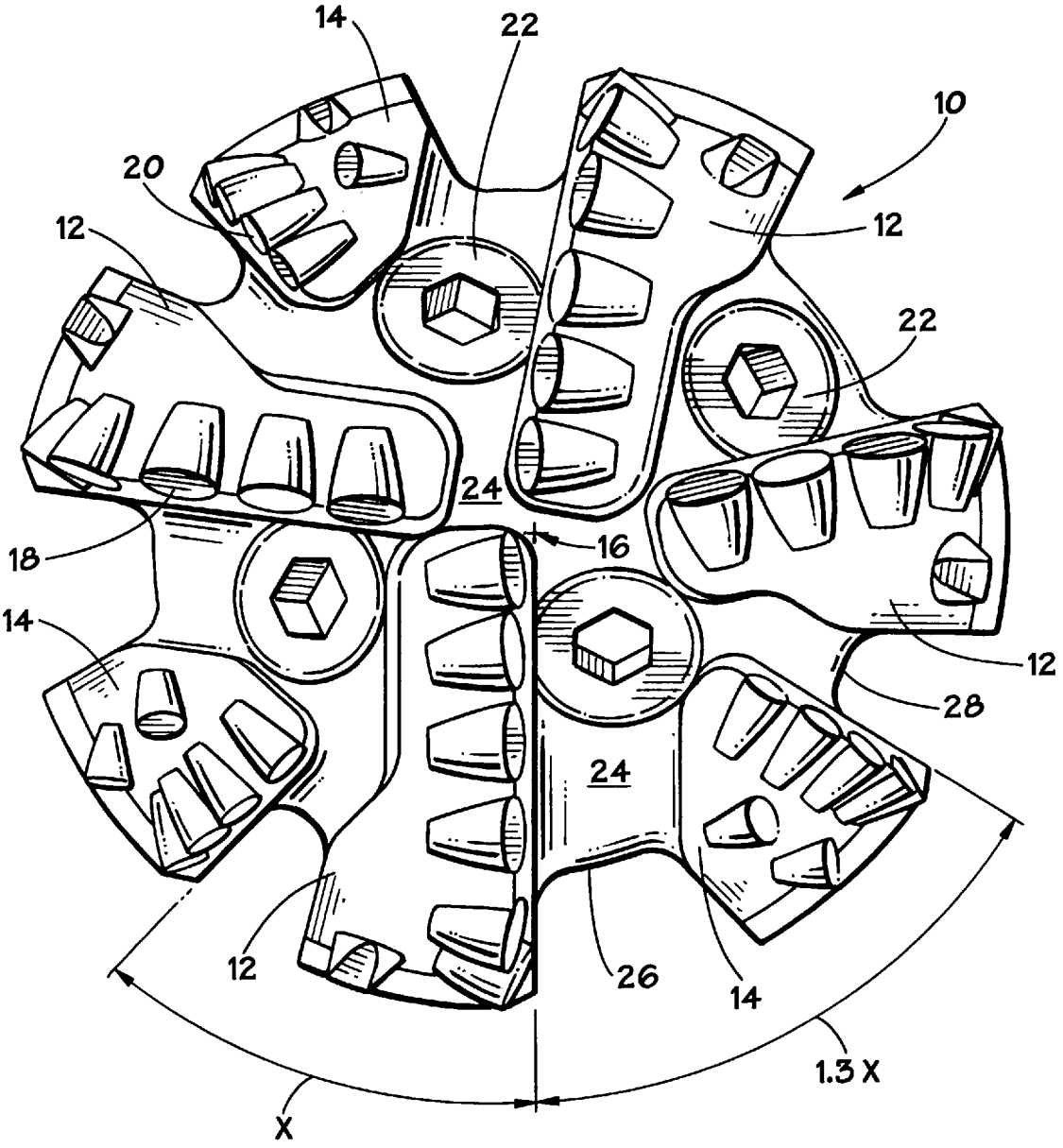
FIG. 1 is an elevational view of one preferred embodiment of a drill bit of the present invention.

Referring to FIG. 1, one preferred embodiment of a drill bit of the present invention comprises a bit body 10 machined from metal, usually steel, which may be hard faced. Alternatively the bit body 10, or a part thereof, may be molded from matrix material using a powder metallurgy process. The methods of manufacturing drill bits of this general type are well known in the art and will not be described in detail. A threaded steel shank (not shown) extends from the bit body 10 for interconnection to a drill string, as is well known to those skilled in the art. On the bit body 10 are formed four primary "longer" or "large" blades 12 and three secondary "shorter" or "small" blades 14. The blades 12 and 14 extend generally radially with respect to the bit axis 16 and are spaced around the circumference of the bit body.

Relatively large cutters 18 are spaced apart side-by-side along each long blade 12 and relatively small cutters 20 are spaced apart side-by-side along each short blade 14. In one preferred embodiment, the cutters 18 are 13 mm in diameter and the cutters 20 are 8 mm in diameter.

Each cutter 18, 20 is generally cylindrical and of circular cross section. Preferably, each cutter 18, 20 includes a preform cutting element comprising a facing table of polycrystalline diamond or other superhard material bonded to a substrate of less hard material, such as cemented tungsten carbide. The cutting element may be bonded to a support post or stud which is received in a socket in the bit body 10 or the substrate itself may be of sufficient length that it may be directly received in a socket in the bit body. Such preform cutting elements are often circular in form although the invention includes within its scope the use of cutting elements of other configurations.

In rotary bits of this kind, it is usual for the cutters 18, 20 on the various blades 12, 14 to be located at different radial distances from the bit axis 16 so that the cutters together define a cutting profile which, in use, covers substantially the whole of the bottom of the bore hole being drilled. For example, it is common for the cutters to be so positioned on the blades that they form a generally spiral array so that the path swept by each cutter partly overlaps the paths swept by the cutters which are at slightly smaller and slightly greater radial distances from the bit axis.

The bit body 10 is formed with a central passage which communicates through subsidiary passages with nozzles 22 mounted at the surface of the bit body 10. In known manner drilling fluid under pressure is delivered to the nozzles 22 through the internal passages and flows outwardly through spaces 24 between adjacent blades 12, 14 for cooling and cleaning the cutters 18, 20. The spaces 24 lead to relatively large junk slots 26 and to relatively small junk slots 28 through which the drilling fluid flows upwardly through the annulus between the drill string and the surrounding formation.

Figure 2:
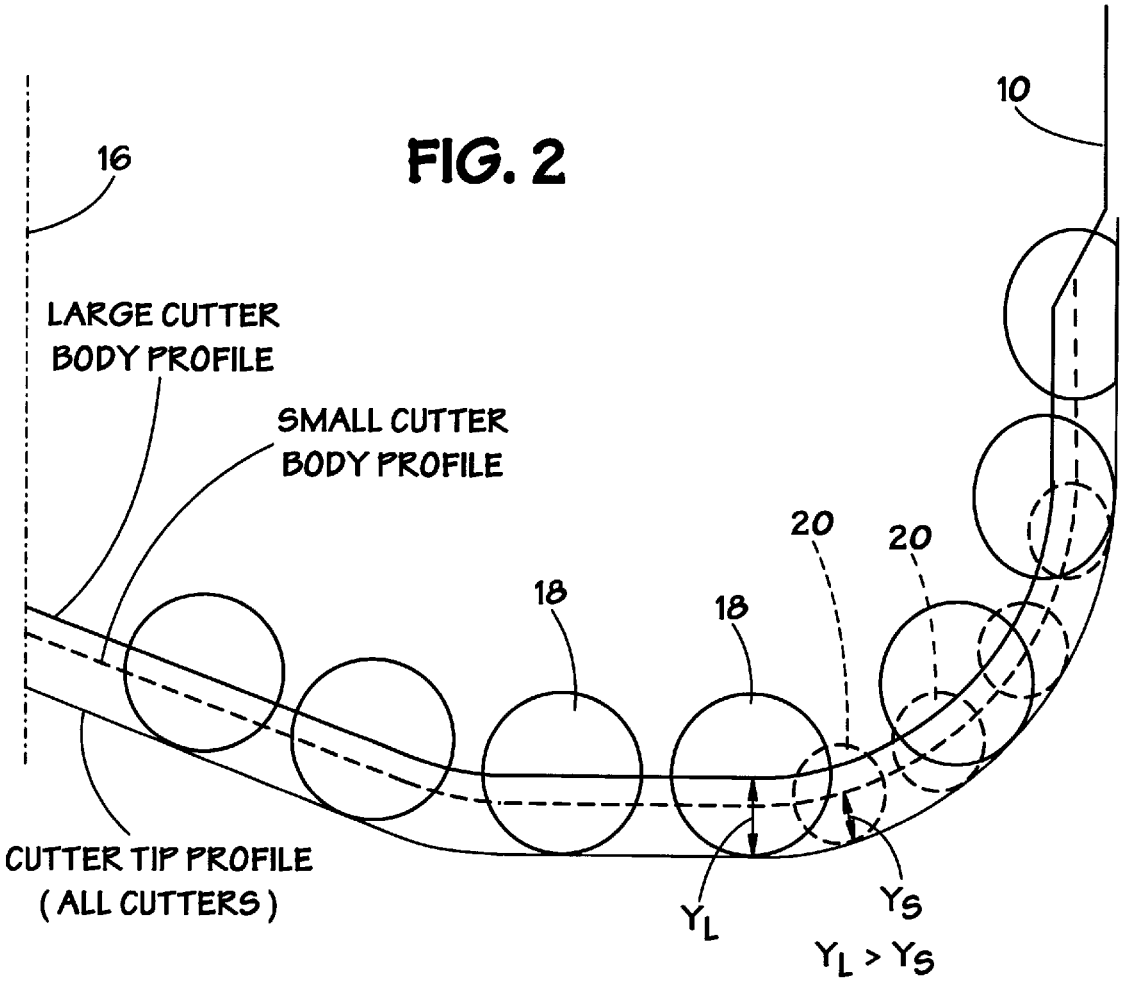
FIG. 2 is a schematic side elevational view of the cutter tip profile, and body profiles of small and large cutters on a drill bit of the present invention.

In order for the drill bit of the present invention to exhibit a rate of penetration (ROP) that is not limited by the size of the small cutters 20, the inventor hereof has found an important design feature that relates the cutter exposure to cutter size and to blade angle. Specifically, as shown in FIG. 2, the small cutters 20 are set within the blades to have less exposure than the large cutters 18. "Exposure" is defined as the distance of cutter tip edge to the blade surface measured perpendicularly to the blade surface. As shown in FIG. 2, the exposure of the large cutters is Yl whereas the cutter exposure of the small cutters is Ys, with Yl being greater than Ys. In one preferred embodiment, the small cutters 20 have a diameter of 8 mm and an exposure of from about 4.0 mm to about 6.0 mm, and the large cutters 18 have a diameter of 13 mm and an exposure of from about 5.5 mm to about 7.0 mm.

The sweep angles of the blades are chosen so that the small blades 14 have less sweep angle than the large blades 12. In other words, radial gap from a front face of a longer blade to a front face of a trailing shorter blade is less than the radial gap from a front face of a shorter blade to a front face of a trailing longer blade. This means that the rotary distance the large cutters travel is greater than the small cutters to contact formation material left by the preceding blade.

In one preferred embodiment, the difference in sweep angle of the small blades 14 is X whereas the sweep angle of the large blades 12 is from about 1.1X to 2X, with about 1.3X to 1.7X being most preferred. In practice this relates to a blade angle of from about 41 to about 45 degrees for the small blades 14 and from about 55 degrees to about 66 degrees for the large blades 12.

Another inventive feature is that the small cutters 20 have greater exposure in proportion to the small cutter's diameter than the large cutters 18. In one preferred embodiment, the small cutters 20 are 8 mm in diameter and have an exposure of 5 mm, whereas the large cutters 18 are 13 mm in diameter and have an exposure of 7 mm. So, in this example 5 mm/8 mm is greater than 7 mm/13 mm.

Figure 3:
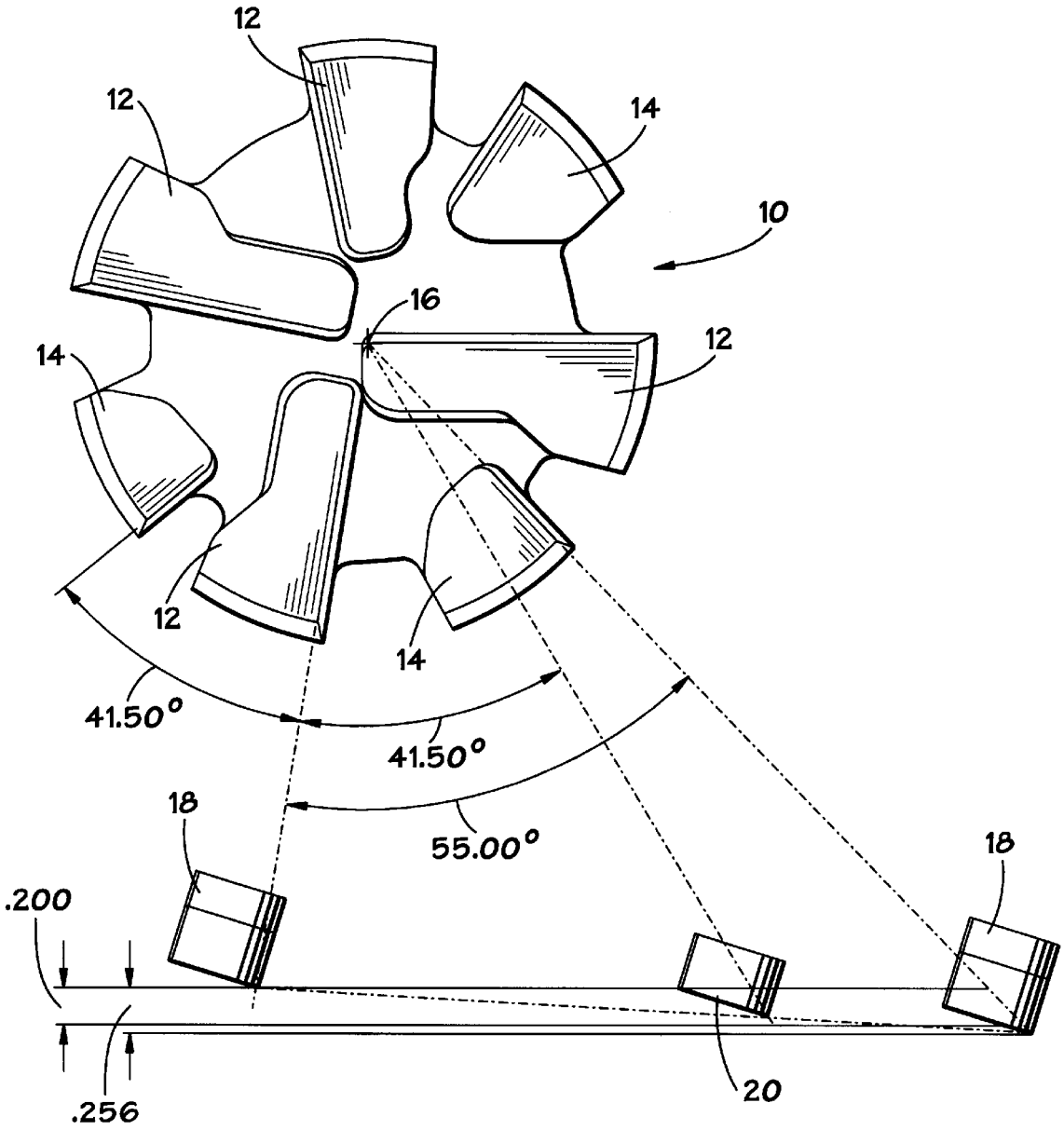
FIG. 3 is a diagrammatic view of a drill bit of the present invention showing relative distance of sweep for differing sized cutters.

As shown in FIG. 3, the above described differences and relationships of cutter exposure combined with the differences and relationships in blade sweep angle enable the drill bit of the present invention to have a ROP performance characteristics that is not limited by the size of the small cutters. In this example, a 6½" seven bladed drill bit with 8 mm and 13 mm cutters has a sweep angle for the small blades of 41.5 degrees and a sweep angle of 55.0 degrees for the large blades. Using well known calculations, it is found that the 13 mm cutters set a depth of penetration of 0.256" per revolution and the 8 mm cutters set a depth of penetration of 0.200" per revolution. However, due to the shorter sweep angle for the small blade (41.5 degrees), the 8 mm cutters do not reach their maximum depth of penetration when the 13 mm cutters reach their maximum depth of penetration. Therefore, the drill bit of the present invention has a ROP not limited by the smaller cutters, as was a problem with prior drill bits.

Figure 4A:
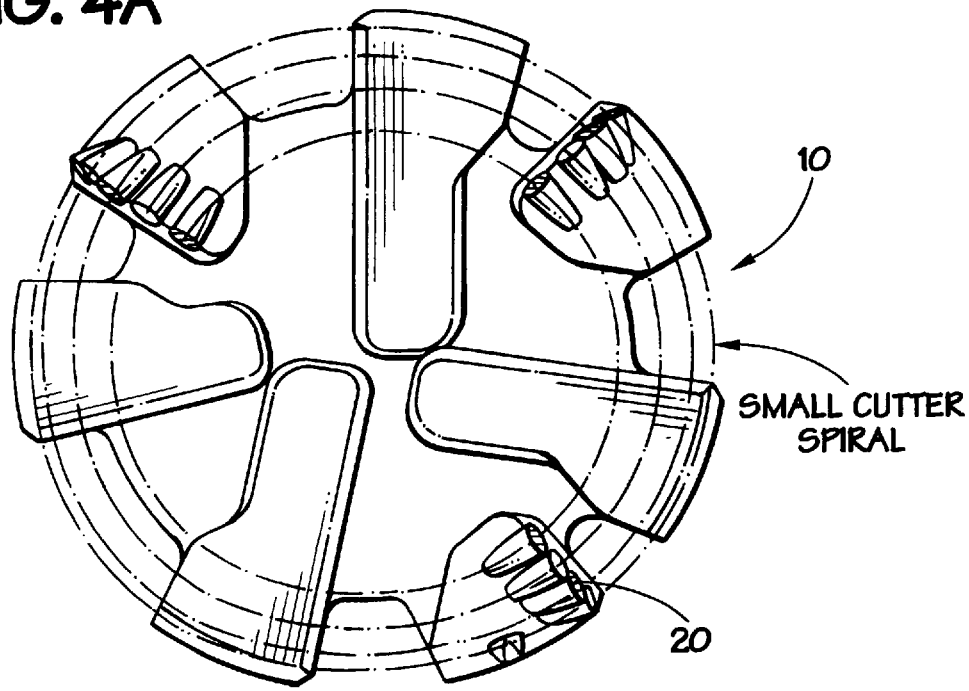
FIG. 4 is an elevational view of a drill bit of the present invention with lines showing two distinct spiral cutter layouts.
Figure 4B:
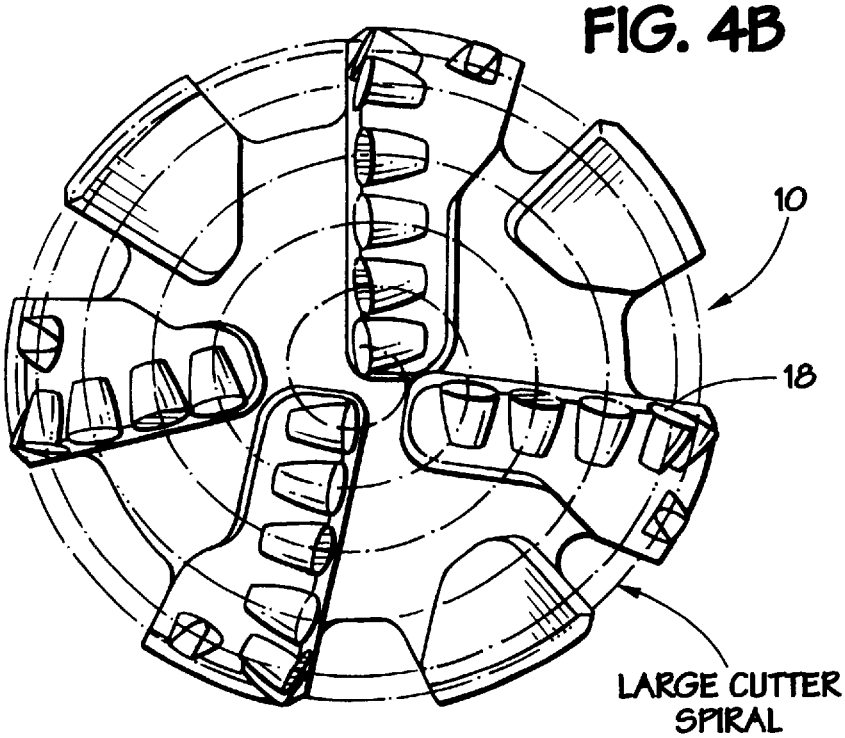

As is well known to those skilled in the art, the cutters on drag type of drill bits are arranged in a spiral pattern to ensure that the entire bottom pattern of the borehole is cut by the cutters. For example, the cutter order starting from the bit axis and progressing outwardly to the bit gauge may progress across blades 1, 3, 5, 7, 2, 4, 6, or any other desired repeating pattern of blade numbers. The inventor hereof has found that a drill bit can have at least two distinct and independent spiral patterns to improve the torque response. As shown in FIG. 4, the drill bit 10 has a first spiral pattern 30 for the large cutters 18 and a second distinct and independent spiral pattern 32 for the small cutters 20. The spiral patterns 30, 32 may or may not have a repeating pattern, but it has been found desirable for these patterns 30, 32 to have repeating patterns. For example, the blade number repeating pattern for the large cutter spiral 30 is 1, 3, 5, 7, 1, 3, 5, 7 etc., while the small cutter spiral 32 is 2, 4, 6, 2, 4, 6, etc.

Due to the differences in the size of the sweep angles of the blades 12, 14 the radial distance of the pattern to repeat, ie. how many degrees around the bit axis before the blade pattern repeats or hereinafter referred to as the "frequency" of a pattern, are not the same for the large and small blades. In one preferred embodiment, the frequency of the small cutter pattern 32 is greater than the frequency of the large cutter pattern 30. It is preferred that the frequency of the small cutter pattern be X and the frequency of the large cutter pattern be from about ⅓ X to about ⅔ X.

This frequency is a function of the spacing of adjacent cutters, rather than the sweep angles. The reason that the small cutter spiral order has a higher frequency is because the cutters can be packed closer together than the large cutters. Therefore, since the cutters are packed closer together, and they are smaller, then the small cutter spiral order will repeat more frequently, ie. a higher frequency.

Figure 5:
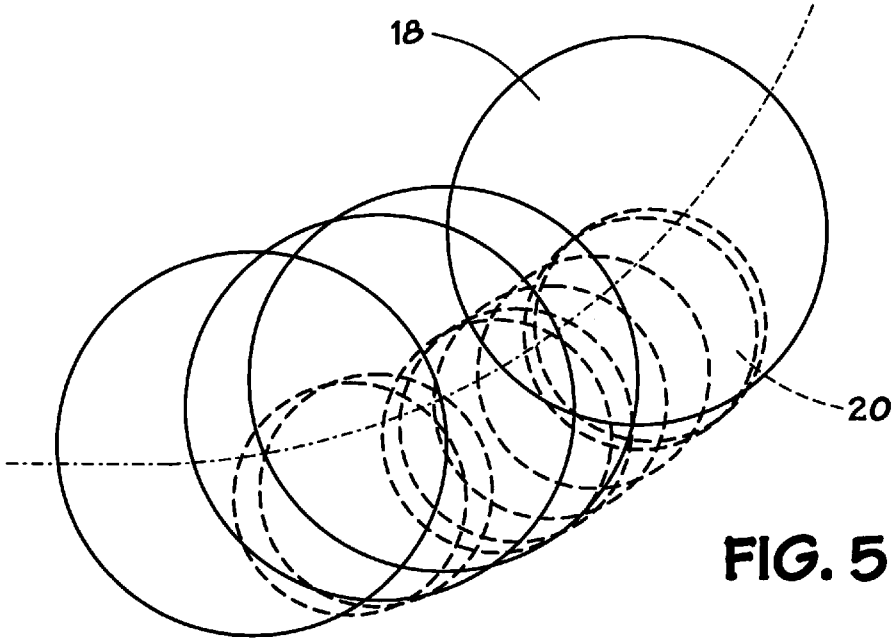
FIG. 5 is a schematic side elevational view of the cutter layout for small and large cutters on a drill bit of the present invention, and showing the differing number of small cutters that may overlap the gap between adjacent large cutters.

To ensure that the torque response of the drill bit of the present invention is as smooth as possible, the inventor hereof has found that the number of small cutters that fit within the cutter tip gap of the large cutters can vary. The number of small cutters that fit within the cutter tip gap of the large cutters varies due to the presence of two different spiral orders and the basic geometry of the bit. The "cutter tip gap" is defined as the distance between the cutter tip radius position of two overlapping cutters. On a cutter rotation, such as shown in FIG. 5, it can be seen that for any two overlapping large cutters from none to x number of small cutters can fit into this gap on the cutter rotation. For example, in FIG. 5, two small cutters fit within a large cutter gap, and six small cutters fit within another large cutter gap.

This filling of the large cutter gap with small cutters can start with the innermost radius position of the first small cutter and then progress outwardly towards the bit gauge.

To have the smoothest wear pattern and therefore the smoothest torque response, the inventor hereof has determined that the cutters and the blades are arranged so that the volumes of the rock removed by the cutters are approximately equal. The determination of the volume of rock removed for any cutter can be easily completed by algorithms that are well known to those skilled in the art. With a drill bit of the differing sized cutters and/or blades, the inventor has found it beneficial to have the volume of rock removed to be similar for adjacent cutters regardless of the angular spacing of the blade. For example, when a large cutter on blade number 5 is followed in the cutter order by a small cutter on blade 4, the radial distance along the bit profile or space between the large and the small cutter is minimized to try to equalize the volume of rock removed. Another way of stating this is that when a large cutter is followed by a small cutter in the cutter tip radius, the volume of rock removed will be approximately equal. FIG. 6 provides a table that has the cutter size, cutter radius position and volume of rock removed for the 6½" example drill bit described previously herein above. By looking at the table of FIG. 6, one skilled in the art will see that the volume factor of the large cutters and the small cutters are approximately equal as compared to the volume factors of adjacent cutters on prior bits.

Figure 7A:
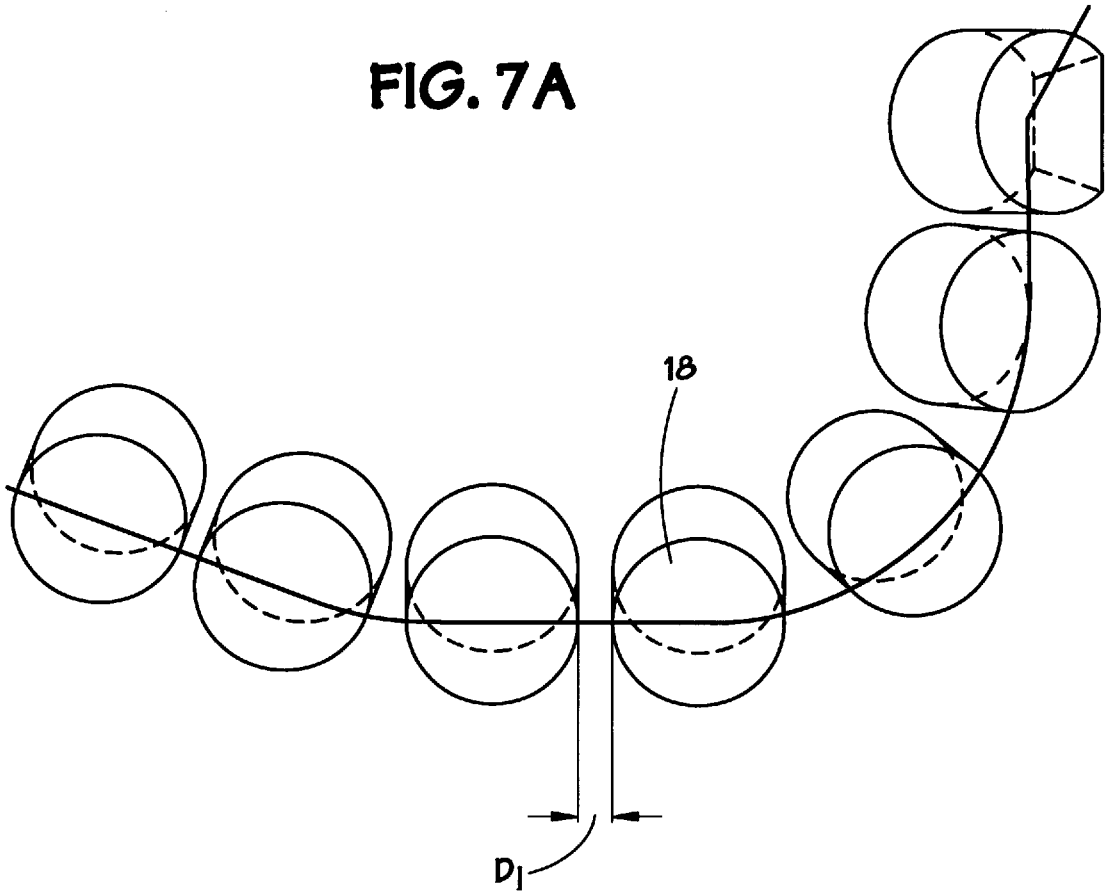
FIGS. 7A and 7B are schematic side views of the cutters on a large blade and on a short blade to show the cutter spacing.
Figure 7B:
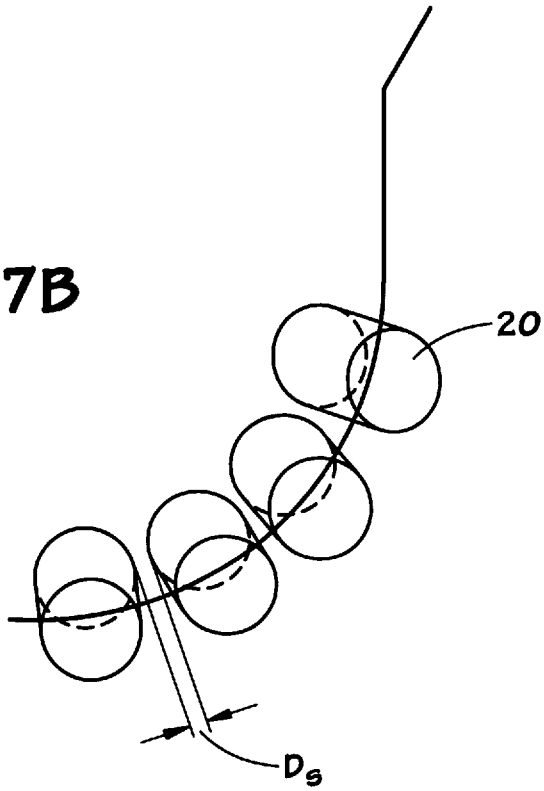

FIGS. 7A and 7B illustrate another feature of the present invention to reduce torque and thereby increase the cutter life, wherein the distance between adjacent cutters on the same blade is approximately equal from blade to blade. Additionally, the distance between adjacent cutters on the same blade is approximately equal regardless of cutter diameter. FIG. 7A shows the distance between large cutters 18 on a large blade 12 is Dl, which is approximately equal to Ds, which is the distance between small cutters 20 on a small blade 14. In the previously used example for a 6½" bit with 8 mm and 13 mm cutters, the distance Dl is from about 0.035 inches to about 0.090 inches, and the distance Ds is from about 0.035 inches to about 0.080 inches.

The drill bit of the present invention has an asymmetric blade layout which enhances bit stability and therefore promotes good directional drilling characteristics. The combination of tightly packed 13 mm and 8 mm cutters produces a seven bladed bit design with a cutter count equivalent to an eight bladed bit that uses only 10 mm cutters. However, with the combination of the 13 mm and 8 mm cutters, there is 30% more diamond cutting area for longer bit life than the 10 mm bit. Finally, the drill bit of the present invention has a higher ROP and less torque than comparable bits with single sized cutters as well as comparable two-sized cutter bits.

Whereas the present invention has been described in particular relation to the drawings attached hereto, it should be understood that other and further modifications, apart from those shown or suggested herein, may be made within the scope and spirit of the present invention.

What is claimed is:

1. A rotary drill bit for drilling subsurface formations, comprising:

a bit body having a shank for connection to a drill string;

a plurality of primary blades and at least one secondary blade circumferentially spaced and extending outwardly away from a central axis of rotation of the bit;

a plurality of cutters mounted along each blade;

a majority of the cutters mounted on each of the primary blades having a greater exposure than a majority of the cutters on the secondary blade; and a sweep angle of the secondary blade is less than a sweep angle of the primary blades.

2. A rotary drill bit of claim 1 wherein the cutters each comprises a facing table of polycrystalline diamond bonded to a substrate of less hard material.

3. A rotary drill bit of claim 1 wherein a majority of the cutters mounted on each of the primary blades are of a larger cross-sectional area than a majority of the cutters on the secondary blade.

4. A rotary drill bit of claim 3 wherein the majority of the cutters on the primary blades are of a greater diameter than a majority of the cutters on the secondary blade.

5. A rotary drill bit of claim 1 wherein a majority of the cutters on the secondary blade have a greater exposure in proportion to diameter than a majority of the cutters on the primary blades.

6. A rotary drill bit of claim 1 and including a plurality of secondary blades.

7. A rotary drill bit of claim 6 wherein the cutters on the primary blades are arranged in a first spiral order, and the cutters on the secondary blades are arranged in a second, separate spiral order.

8. A rotary drill bit of claim 6 wherein the first spiral order has a frequency of repeat not equal to the frequency of repeat of the second spiral order.

9. A rotary drill bit of claim 8 wherein the frequency of repeat of the first spiral order is less than the frequency of repeat of the second spiral order.

10. A rotary drill bit of claim 6 wherein one or more cutters on the secondary blades have cutter tip radius positions that are at or within a cutter tip radii gap formed by the cutter tip radii of two overlapping cutters on at least two of the primary blades.

11. A rotary drill bit of claim 6 wherein spacings between adjacent cutters on each of the secondary blades are approximately equal.

12. A rotary drill bit of claim 1 wherein a volume factor of a cutter on a primary blade is approximately equal to a volume factor of a cutter on a secondary blade that is adjacent in cutter order.

13. A rotary drill bit of claim 1 wherein spacings between adjacent cutters on each of the primary blades are approximately equal.

14. A rotary drill bit of claim 1 wherein spacings between adjacent cutters on all of the blades are approximately equal.

15. A rotary drill bit for drilling subsurface formations, comprising:

a bit body having a shank for connection to a drill string;

a plurality of primary blades and a plurality of secondary blades circumferentially spaced and extending outwardly away from a central axis of rotation of the bit;

a plurality of cutters mounted along each blade; and the cutters on the primary blades are arranged in a first spiral order, and the cutters on the secondary blades are arranged in a second, separate spiral order.

16. A rotary drill bit of claim 15 wherein the first spiral order has a frequency of repeat not equal to the frequency of repeat of the second spiral order.

17. A rotary drill bit of claim 15 wherein the frequency of repeat of the first spiral order is less than the frequency of repeat of the second spiral order.

18. A rotary drill bit for drilling subsurface formations, comprising:

a bit body having a shank for connection to a drill string;

a plurality of primary blades and secondary blades circumferentially spaced and extending outwardly away from a central axis of rotation of the bit;

a plurality of cutters mounted along each blade; and a volume factor of a cutter on a primary blade is approximately equal to a volume factor of a cutter on a secondary blade that is adjacent in cutter order.

19. A rotary drill bit for drilling subsurface formations, comprising:

a bit body having a shank for connection to a drill string;

a plurality of primary blades and secondary blades circumferentially spaced and extending outwardly away from a central axis of rotation of the bit;

a plurality of first size cutters mounted along each of the primary blades, and a plurality of smaller second size cutters mounted along the at least one secondary blade; and spacings between adjacent cutters on each of the primary blades are approximately equal.

20. A rotary drill bit of claim 19 wherein spacings between adjacent cutters on each of the secondary blades are approximately equal.

21. A rotary drill bit of claim 19 wherein spacings between adjacent cutters on all of the blades are approximately equal.

22. A rotary drill bit for drilling subsurface formations, comprising:

a bit body having a shank for connection to a drill string;

a plurality of primary blades and at least one secondary blade circumferentially spaced and extending outwardly away from a central axis of rotation of the bit;

a plurality of first size cutters mounted along each of the primary blades, and a plurality of smaller second size cutters mounted along the at least one secondary blade;

a majority of the first size cutters mounted on each of the primary blades having a greater exposure than a majority of the second size cutters on the at least one secondary blade; and a sweep angle of the at least one secondary blade is less than a sweep angle of the primary blades.

23. A rotary drill bit for drilling subsurface formations, comprising:

a bit body having a shank for connection to a drill string;

a plurality of primary blades and at least one secondary blade circumferentially spaced and extending outwardly away from a central axis of rotation of the bit;

a plurality of first size cutters mounted along each of the primary blades, and a plurality of smaller second size cutters mounted along the at least one secondary blade; and the exposure of the cutters and the blade sweep angles being within a range to cause the drill bit to exhibit a rate-of-penetration as a function of the size of the cutters on the primary blades and to exhibit a torque profile as a function of the size of the cutters on the at least one secondary blade.

24. A rotary drill bit for drilling subsurface formations, the drill bit comprising:

a bit body;

a plurality of primary blades and a plurality of secondary blades circumferentially spaced on the bit body and extending outwardly from a central axis of rotation of the bit; and a plurality of cutters disposed on each blade, a majority of the cutters on each primary blade having a greater exposure than a majority of the cutters on each secondary blade wherein the cutters on the primary blades are arranged in a first spiral order, and wherein the cutters on the secondary blades are arranged in a second spiral order, the cutters on the primary blades being excluded from the second spiral order and the cutters on the secondary blades being excluded from the first spiral order.

25. The drill bit, as set forth in claim 24, wherein the bit body comprises a shank for connection to a drill string.

26. The drill bit, as set forth in claim 24, wherein a majority of the cutters on each primary blade are of a larger cross-sectional area than a majority of the cutters on each secondary blade.

27. The drill bit, as set forth in claim 24, wherein a majority of the cutters on each primary blade have a greater exposure in proportion to diameter than a majority of the cutters on each secondary blade.

28. The drill bit, as set forth in claim 24, wherein the first spiral order has a first frequency of repeat and wherein the second spiral order has a second frequency of repeat, the first frequency of repeat being different than the second frequency of repeat.

29. The drill bit, as set forth in claim 28, wherein the first frequency of repeat is less than the second frequency of repeat.

30. The drill bit, as set forth in claim 24, wherein at least one cutter on the secondary blades has a cutter tip radius position that is at or within a cutter tip radii gap formed by cutter tip radii of two overlapping cutters on at least two of the primary blades.

31. A rotary drill bit for drilling subsurface formations, the drill bit comprising:

a bit body;

a plurality of primary blades circumferentially spaced on the bit body and extending outwardly from a central axis of rotation of the bit;

a plurality of secondary blades circumferentially spaced on the bit body and extending outwardly from a central axis of rotation of the bit; and a plurality of cutters disposed on each blade, the cutters on the primary blades being arranged in a first repeating order, and the cutters on the secondary blades being arranged in a second repeating order, the cutters on the primary blades being excluded from the second repeating order and the cutters on the secondary blades being excluded from the first repeating order, wherein the first repeating order comprises a first spiral order of cutters disposed only on the primary blades, and wherein the second repeating order comprises a second spiral order of cutters disposed only on the secondary blades.

32. The drill bit, as set forth in claim 31, wherein the first repeating order has a first frequency of repeat and wherein the second repeating order has a second frequency of repeat, the first frequency of repeat being different than the second frequency of repeat.

33. A rotary drill bit for drilling subsurface formations, the drill bit comprising:

a bit body;

a plurality of primary blades circumferentially spaced on the bit body and extending outwardly from a central axis of rotation of the bit;

a plurality of secondary blades circumferentially spaced on the bit body and extending outwardly from a central axis of rotation of the bit; and a plurality of cutters disposed on each blade, wherein a volume factor of the cutters on each primary blade is approximately equal to a volume factor of the cutters on each respective secondary blade that follows in cutting order.

34. A rotary drill bit for drilling subsurface formations, the drill bit comprising:

a bit body;

a plurality of primary blades circumferentially spaced on the bit body and extending outwardly from a central axis of rotation of the bit;

a plurality of secondary blades circumferentially spaced on the bit body and extending outwardly from a central axis of rotation of the bit;

a first plurality of cutters disposed on each primary blade, each of the first plurality of cutters being spaced from one another by a first distance; and a second plurality of cutters disposed on each secondary blade, each of the second plurality of cutters being spaced from one another by a second distance, wherein the first distance is different than the second distance.

35. The drill bit, as set forth in claim 34, wherein the first plurality of cutters are a first size and the second plurality of cutters are a second size, the first size being different than the second size.

36. The drill bit, as set forth in claim 35, wherein the first size is larger than the second size.

37. The drill bit, as set forth in claim 34, wherein the primary blades have a sweep angle that is greater than a sweep angle of the secondary blades.

* * * * *

UNITED STATES PATENT AND TRADEMARK OFFICE
CERTIFICATE OF CORRECTION

Patent No. : 5,816,346
Dated : October 6, 1998
Inventor(s) : Timothy P. Beaton

It is certified that error appears in the above-identified patent and that said Letters Patent are here corrected as shown below:

On the title page, item

[73] Assignee: Camco International, Inc., "Austin", Tex. should read --Houston--

Signed and Sealed this

Sixth Day of April, 1999

*Attest:*

Q. TODD DICKINSON

*Attesting Officer*

*Acting Commissioner of Patents and Trademarks*